US007494697B2

(12) United States Patent
Wang et al.

(10) Patent No.: US 7,494,697 B2
(45) Date of Patent: Feb. 24, 2009

(54) SUBSTRATE OF ARTIFICIAL LEATHER INCLUDING ULTRAFINE FIBERS AND METHODS FOR MAKING THE SAME

(75) Inventors: Lung-Chuan Wang, Renwu Shiang (TW); Chung-Chih Feng, Sanmin (TW); Kuo-Kuang Cheng, Daliao Shiang (TW); Ta-Min Cheng, Qianzhen (TW); Chih-Yi Lin, Gushan (TW); Kuan-Hsiang Chang, Daliao Shiang (TW); Gao-Long Yang, Sanmin (TW)

(73) Assignee: San Fang Chemical Industry Co., Ltd., Jenwu Shiang (TW)

( * ) Notice: Subject to any disclaimer, the term of this patent is extended or adjusted under 35 U.S.C. 154(b) by 251 days.

(21) Appl. No.: 11/432,464

(22) Filed: May 11, 2006

(65) Prior Publication Data

US 2006/0263601 A1 Nov. 23, 2006

(30) Foreign Application Priority Data

May 17, 2005 (TW) ..... 94116003 A

(51) Int. Cl.
*H05B 6/64* (2006.01)
*B05D 3/02* (2006.01)
*D01D 5/30* (2006.01)

(52) U.S. Cl. ..... 427/595; 427/430.1; 427/314; 264/172.11

(58) Field of Classification Search ..... 427/457, 427/595, 314
See application file for complete search history.

(56) References Cited

U.S. PATENT DOCUMENTS 2,116,289 A 5/1938 Shepherd ..... 118/212
3,383,273 A 5/1968 Roland et al. ..... 442/352
3,531,368 A 9/1970 Okamoto et al.
3,590,112 A 6/1971 Civardi ..... 264/321
3,716,614 A 2/1973 Okamoto et al. ..... 264/49
3,835,212 A 9/1974 Piacente ..... 264/76
3,841,897 A 10/1974 Okazaki et al. ..... 428/151
3,865,678 A 2/1975 Okamoto et al. ..... 428/91

(Continued)

FOREIGN PATENT DOCUMENTS

CN 1346912 5/2002

(Continued)

OTHER PUBLICATIONS

Mesh Size and Micron Size: Coral Calcium Absorption. Internet Reference. URL: www.healthtreasures.com/mesh-microns.html.

*Primary Examiner*—Timothy H Meeks
*Assistant Examiner*—David Turocy
(74) *Attorney, Agent, or Firm*—Alan Kamrath; Kamrath & Associates PA

(57) ABSTRACT

There is provided a method for splitting a split type conjugate fiber. The method includes four steps. Firstly, there is provided a first polymer with crystallization of 40% to 95% and a second polymer with crystallization of 1% to 25%. Secondly, a conjugate fiber is made of the first and second polymers by conjugate spinning. Thirdly, the conjugate fiber is submerged in water so that the conjugate fiber contains water. Finally, the conjugate fiber is heated and split into fine fibers.

16 Claims, 4 Drawing Sheets

U.S. PATENT DOCUMENTS

| | | | | |
|---|---|---|---|---|
| 3,900,549 | A | 8/1975 | Yamane et al. | 264/172.13 |
| 3,917,784 | A * | 11/1975 | Nishida | 264/103 |
| 3,924,045 | A * | 12/1975 | Ogasawara et al. | 428/373 |
| 3,989,869 | A | 11/1976 | Neumaier et al. | 442/226 |
| 4,018,954 | A | 4/1977 | Fukushima et al. | 428/86 |
| 4,045,598 | A | 8/1977 | Henson | 427/296 |
| 4,067,833 | A | 1/1978 | Austin et al. | 521/164 |
| 4,096,104 | A | 6/1978 | Spain et al. | 427/227 |
| 4,145,468 | A | 3/1979 | Mizoguchi et al. | 428/239 |
| 4,216,251 | A | 8/1980 | Nishimura et al. | 427/370 |
| 4,250,308 | A | 2/1981 | Goedecke et al. | 544/190 |
| 4,259,384 | A | 3/1981 | Veiga et al. | 428/97 |
| 4,342,805 | A | 8/1982 | McCartney | 428/151 |
| 4,363,845 | A | 12/1982 | Hartmann | 428/198 |
| 4,433,095 | A | 2/1984 | Hombach et al. | 524/563 |
| 4,476,186 | A | 10/1984 | Kato et al. | 442/60 |
| 4,587,142 | A | 5/1986 | Higuchi et al. | 428/15 |
| 4,708,839 | A | 11/1987 | Bellet et al. | 264/85 |
| 4,728,552 | A | 3/1988 | Jensen, Jr. | 428/91 |
| 4,841,680 | A | 6/1989 | Hoffstein et al. | 51/283 |
| 4,927,432 | A | 5/1990 | Budinger et al. | 51/298 |
| 4,954,141 | A | 9/1990 | Takiyama et al. | 51/296 |
| 4,966,808 | A | 10/1990 | Kawano | 442/201 |
| 4,997,876 | A | 3/1991 | Scarso | 524/706 |
| 5,020,283 | A | 6/1991 | Tuttle | 51/209 |
| 5,094,670 | A | 3/1992 | Imada | 51/293 |
| 5,124,194 | A | 6/1992 | Kawano | 442/201 |
| 5,197,999 | A | 3/1993 | Thomas | 51/298 |
| 5,212,910 | A | 5/1993 | Breivogel et al. | 51/398 |
| 5,216,843 | A | 6/1993 | Breivogel et al. | 51/131.1 |
| 5,225,267 | A | 7/1993 | Ochi et al. | 428/214 |
| 5,242,750 | A | 9/1993 | Wagner et al. | 428/316.6 |
| 5,290,626 | A | 3/1994 | Nishioi et al. | 442/201 |
| 5,297,364 | A | 3/1994 | Tuttle | 51/209 |
| 5,394,655 | A | 3/1995 | Allen et al. | 451/63 |
| 5,484,646 | A | 1/1996 | Mann | 428/198 |
| 5,489,233 | A | 2/1996 | Cook et al. | 451/41 |
| 5,503,899 | A | 4/1996 | Ashida et al. | 428/151 |
| 5,510,175 | A | 4/1996 | Shiozawa | 442/77 |
| 5,518,800 | A | 5/1996 | Okawa et al. | 428/151 |
| 5,533,923 | A | 7/1996 | Shamouilian et al. | 451/41 |
| 5,554,064 | A | 9/1996 | Breivogel et al. | 451/41 |
| 5,562,530 | A | 10/1996 | Runnels et al. | 451/36 |
| 5,611,943 | A | 3/1997 | Cadien et al. | 216/88 |
| 5,662,966 | A | 9/1997 | Kobayasi | 427/385.5 |
| 5,993,943 | A | 11/1999 | Bodaghi et al. | 428/198 |
| 6,159,581 | A | 12/2000 | Yoneda et al. | 428/195 |
| 6,322,851 | B1 | 11/2001 | Adachi et al. | 427/246 |
| 6,451,404 | B1 | 9/2002 | Nobuto et al. | 428/91 |
| 6,451,716 | B1 | 9/2002 | Sasaki et al. | 442/77 |
| 6,468,651 | B2 | 10/2002 | Aikawa et al. | 428/364 |
| 6,479,153 | B1 | 11/2002 | Kato et al. | 428/423.7 |
| 6,515,223 | B2 | 2/2003 | Tashjian | 174/35 R |
| 6,517,938 | B1 | 2/2003 | Andoh et al. | 428/395 |
| 6,528,139 | B2 | 3/2003 | Hoyt et al. | 428/97 |
| 6,613,867 | B2 | 9/2003 | Sonnenschein et al. | 528/76 |
| 6,767,853 | B1 | 7/2004 | Nakayama et al. | 442/361 |
| 6,852,392 | B2 | 2/2005 | Kikuchi et al. | 428/166 |
| 6,852,418 | B1 | 2/2005 | Zurbig et al. | 428/423.1 |
| 6,860,802 | B1 | 3/2005 | Vishwanathan | 451/527 |
| 7,025,915 | B2 | 4/2006 | Wang et al. | 264/103 |
| 2002/0013984 | A1 | 2/2002 | Makiyama et al. | 28/103 |
| 2002/0098756 | A1 | 7/2002 | Sasaki et al. | 442/77 |
| 2003/0139110 | A1 * | 7/2003 | Nagaoka et al. | 442/347 |
| 2004/0045145 | A1 | 3/2004 | Wang et al. | 28/168 |
| 2004/0063370 | A1 | 4/2004 | Makiyama et al. | 442/363 |
| 2004/0142148 | A1 | 7/2004 | Feng et al. | 428/151 |
| 2004/0191412 | A1 | 9/2004 | Wang et al. | 427/245 |
| 2004/0253404 | A1 | 12/2004 | Wang et al. | 428/41.8 |
| 2005/0100710 | A1 | 5/2005 | Feng et al. | 428/151 |
| 2005/0244654 | A1 | 11/2005 | Wang et al. | 428/423.1 |
| 2005/0260416 | A1 | 11/2005 | Wang et al. | 428/423.1 |
| 2006/0046597 | A1 | 3/2006 | Wang et al. | 442/394 |
| 2006/0057432 | A1 | 3/2006 | Feng et al. | 428/904 |
| 2006/0147642 | A1 | 7/2006 | Wang et al. | 427/430.1 |
| 2006/0160449 | A1 | 7/2006 | Wang et al. | 442/182 |
| 2006/0218729 | A1 | 10/2006 | Feng | 8/94.15 |
| 2006/0249244 | A1 | 11/2006 | Wang et al. | 156/239 |
| 2006/0263601 | A1 | 11/2006 | Wang et al. | 428/373 |
| 2006/0272770 | A1 | 12/2006 | Lee et al. | 156/322 |

FOREIGN PATENT DOCUMENTS

| | | |
|---|---|---|
| DE | 3536371 | 5/1987 |
| DE | 10100814 | 7/2001 |
| EP | 1041191 | 10/2000 |
| EP | 1054096 | 11/2000 |
| JP | 52047896 | 4/1977 |
| JP | 55051076 | 4/1980 |
| JP | 05117584 | 5/1993 |
| JP | 06192969 | 7/1994 |
| JP | 08291454 | 11/1996 |
| JP | 09059881 | 3/1997 |
| JP | 11093082 | 4/1999 |
| JP | 200248431 | 9/2000 |
| KR | 2002004295 | 1/2002 |
| WO | WO 9615887 | 5/1996 |
| WO | WO 0002707 | 1/2000 |
| WO | WO2004044028 | 5/2004 |

* cited by examiner

SUBSTRATE OF ARTIFICIAL LEATHER INCLUDING ULTRAFINE FIBERS AND METHODS FOR MAKING THE SAME

BACKGROUND OF INVENTION

1. Field of Invention

The present invention relates to methods for splitting split type conjugate fibers and artificial leather made by the methods.

2. Related Prior Art

A so-called conjugate fiber includes two or more polymers of different types or two or more polymers of the same type but with different properties. The polymers are spun to form chemical fibers by a conjugate spinning method. In the conjugate spinning method, two different polymers are molten and respectively flow in two channels and then meet at an inlet of a spinneret. The molten polymers are extruded from the spinneret and then solidified into a conjugate fiber. The conjugate fiber is often reeled for later use. According to different positions of the polymers in a cross-sectional view, the conjugate fibers can be classified into a split type (including side by side type and sheath/core type) and a sea-island type. The fibers in a split type conjugate fiber may be separated from one another by a mechanic method or a dissolution method. Alternatively, certain portions of the polymers may be dissolved for the purposes of thinning the fibers.

The fineness of a so-called ultrafine fiber is smaller than 0.3 dtex. Conventionally, to make artificial leather from the ultrafine fibers, a non-woven fabric (or "substrate") made from conjugate fibers is submerged in a resin. The conjugate fibers of the substrate are dissolving so as to provide a semi-product of the artificial leather including ultrafine fibers each with a fineness smaller than 0.3 dtex. Finally, a superficial layer is adhered to the semi-product of the artificial leather to provide the final product of the artificial leather. This artificial leather includes a microstructure like that of real leather and is soft, light and excellent in drape. However, a lot of solvent or alkali solution is used in the dissolution step of the conjugate fibers.

For example, Taiwanese Patent Publication No. 101199 discloses a method for making ultrafine fibers and fabrics of the same. Each of the fibers is coated with a film of polyester. The films of polyester are dissolved in an alkali solution before the fibers are mechanically split. However, toxic waste is produced as a result of the dissolving of the films of polyester by the alkali solution, leading to grave pollution of water. The alkali solution that dissolves the films of polyester can be recycled; however, the cost is inevitably increased.

Taiwanese Patent Publication No. 252156 discloses a method for splitting conjugate fibers. Each of the conjugate fibers includes polymers arranged like the segments of an orange based on their different crystallization. The speed of reeling during spinning is increased to 3000-8000 m/min. The increased speed of reeling stretches and tears and therefore splits the fibers. However, when the number of the segments is large, the splitting result of the fibers is poor due to incomplete tearing or breakage of some of the fibers.

Taiwanese Patent Publication No. 179714 discloses a method for splitting conjugate fibers and fabrics of the same. Each of the conjugate fibers includes polymers of polyamide and polyester arranged like the segments of an orange. However, because the two polymers adhere to each other well, benzyl alcohol, caustic sodium or an acid solvent must be used to dissolve the polyamide or polyester so as to split the fibers, and hence causes serious pollution of water.

Taiwanese Patent Publication No. 202489 discloses a method for splitting fibers and a method for dying the same. An acid solvent is used to dissolve polyamide so as to obtain ultrafine fibers of polyester. Produced in the method is waste that cannot easily be handled.

Japanese Patent Publication 1993-331758 discloses production of ultrafine fiber. A conjugate fiber is made of two polymers that properly adhere to each other so that they are not separated from each other during combing and needle punch and that they are separated from each other for their different degrees of contraction in boiling hot water during mechanical splitting. However, it has proven to be inadequate when the number of splitting is large.

Japanese Patent Publication 1993-051820 discloses conjugate fiber that can be split. The conjugate fiber includes a plurality of parts made of PET that is modified so that it can easily be dissolving. The parts are in parallel to each other. Thus, the conjugate fiber can easily be split. However, PET must be dissolved by an alkali solvent such as caustic sodium during splitting. Therefore, there is serious pollution of water.

The present invention is therefore intended to obviate or at least alleviate the problems encountered in prior art.

SUMMARY OF INVENTION

It is an objective of the present invention to provide artificial leather with a substrate that is made of split type conjugate fibers that are split without the use of any alkali solvent for dissolving the conjugate fibers.

It is another objective of the present invention to provide artificial leather of excellent softness and drape.

To achieve the objectives, there are provided a first polymer at a crystallization degree of 40% to 95% and a second polymer at a crystallization degree of 1% to 25%. In a conjugate spinning method, the first and second polymers are made into a conjugate fiber including a plurality of parts arranged like the segments of an orange. The conjugate fiber can be made into a non-woven fabric by needle punch, spunlace or spunbond. The non-woven fabric is submerged in water so that the conjugate fiber contains water. Then, the non-woven fabric is heated so that the water content is removed. During the heating method, different chemical reactions happen to the first and second polymers at different crystallization degrees so that the parts are torn and separated. Moreover, during heating method, the water content becomes vapor or steam that blows and splits the conjugate fiber. Without the use of any alkali solvent, the conjugate fiber is split and the parts of the polymers become flat strips. Moreover, the non-woven fabric is contracted. The present invention is environment-friendly.

According to the present invention, there is provided a method for making and splitting a conjugate fiber. Firstly, a first polymer at a crystallization degree of 40% to 95% and a second polymer at a crystallization degree of 1% to 25% are provided. Secondly, the first and second polymers are made into a conjugate fiber including a plurality of parts arranged like the segments of an orange. Thirdly, water is provided to the conjugate fiber. Fourthly, the conjugate fiber is heated.

In a further aspect of the present invention, there is provided a method for making and splitting a conjugate fiber. Firstly, a first polymer at a crystallization degree of 40% to 95% and a second polymer at a crystallization degree of 1% to 25% are provided. Secondly, the first and second polymers are made into a conjugate fiber consisting of parts arranged like the segments of an orange. Thirdly, the conjugate fiber is made into a non-woven fabric. Fourthly, water is provided to the non-woven fabric. Fifthly, the non-woven fabric is heated.

Preferably, the heating is conducted by microwave so that the conjugate fiber that contains the water can be heated evenly and split effectively.

The substrate obtained according to the foregoing methods can be abraded, scrubbed or stricken, or a superficial layer can be adhered to the substrate so as to provide artificial leather with fine grain on the surface and inside.

Other objectives, advantages and features of the present invention will become apparent from the following description referring to the attached drawings.

BRIEF DESCRIPTION OF DRAWINGS

The present invention will be described through detailed illustration of several embodiments referring to the drawings.

DETAILED DESCRIPTION OF EMBODIMENTS

According to the general concept of the present invention, there is provided a method for making and splitting a conjugate fiber so as to provide ultrafine fibers and for making a substrate from the ultrafine fibers and for making artificial leather from the substrate.

Figure 1:
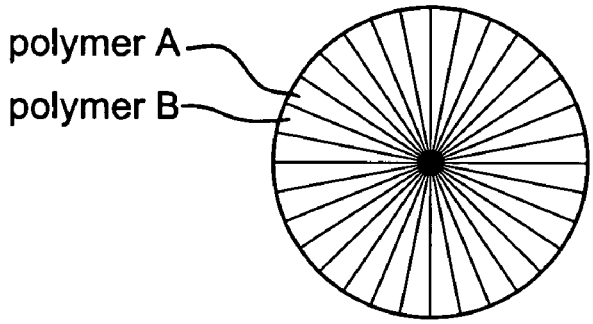
FIG. 1 is a cross-sectional view of a conjugate fiber made in a method according to the present invention.
Figure 2:
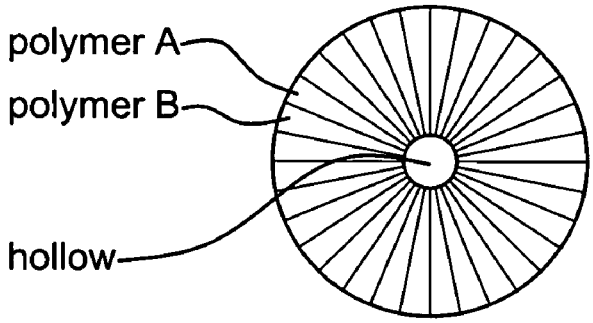
FIG. 2 is a cross-sectional view of another conjugate fiber made in the method according to the present invention.
Figure 3:
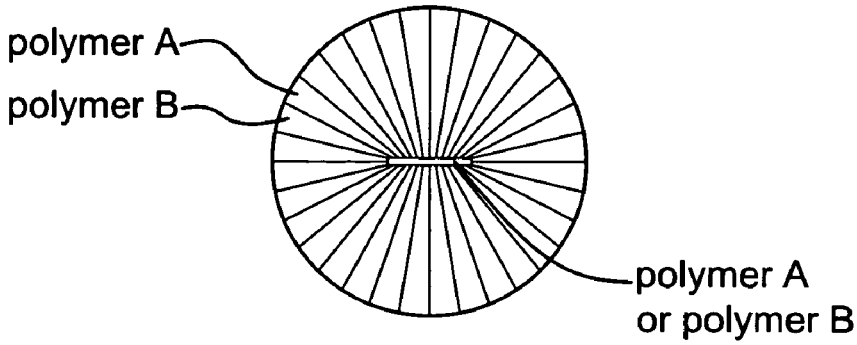
FIG. 3 is a cross-sectional view of another conjugate fiber made in the method according to the present invention.

Referring to FIGS. 1 through 3, there are provided a first polymer marked by the letter "A" and a second polymer marked by the letter "B". The first polymer includes a crystallization degree of 40% to 95%. The second polymer includes crystallization degree of 1% to 25%. The first and second polymers are mixed at a ratio of 90:10 to 10:90. In a conjugate spinning method, the first polymer is molten at a temperature of 200 to 300 degrees Celsius while the second polymer is molten at a temperature of 180 to 290 degrees Celsius. There is used a spinneret that includes a radial configuration so as to spin the first and second polymers to form the parts in an alternate manner. When reaching the spinneret, the first and second polymers are at a temperature of 200 to 290 degrees Celsius. The conjugate fiber is reeled at a rate of 300 to 2000 m/min so that the fineness of the conjugate fiber is 5 to 20 den. The conjugate fiber is drawn by air at a speed of 3500 to 7000 m/min so that the fineness of the conjugate fiber becomes 2 to 10 den. The parts are arranged like the segments of an orange. The conjugate fiber includes 24 to 128 parts.

It is well known to provide such a conjugate fiber in such a conjugate spinning method. Generally, at least two compatible polymers are extruded so as to adhere to each other, thus forming a conjugate fiber.

The conjugate fiber can be drawn, crimped, oil finish and cut so as to form staple fibers of 2 to 10 den.

The staple fibers are opening, carding and cross-lapping so as to form a non-woven fabric of which the unit weight is 100 to 700 g/m$^2$ by needle punch or spunlace.

The fully extended conjugate fiber can directly be cross-lapping so that the unit weight becomes 100 to 700 g/m$^2$ and processed by a needle punch machine or spunlace machine so as to form a non-woven fabric.

In spunlace, water jets are used to cause the fibers to entangle with one another, and the polyester and polyamide of the fibers are rushed and separated by the water jets. Slow water is provided onto the surface of the non-woven fabric so as to form turbulences for cleaning the surface of the non-woven fabric so that the unit weight becomes 100 to 700 g/m$^2$.

The non-woven fabric is submerged in water so that the weight of the water is about 0.5% to 50% of that of the non-woven fabric. Then, the water is vaporized by microwave at a rate of vaporizing 1 gram of water per minute with 10 watt to 500 watt. Therefore, the heating separates the first and second polymers from each other for two reasons. Firstly, because of the very different crystallization degrees of the first and second polymers, the heat provided by the microwave causes the very different contraction degrees of the first and second polymers. Thus, the first and second polymers are torn and separated from each other. Secondly, for containing a lot of water, when the second polymer it is subject to the microwave, the water vaporizes and expands instantly and bursts from the interface between the first and second polymers. Therefore, the first and second polymers can easily be separated from each other by the bursting vapor without using any alkali solvent.

Figure 4:
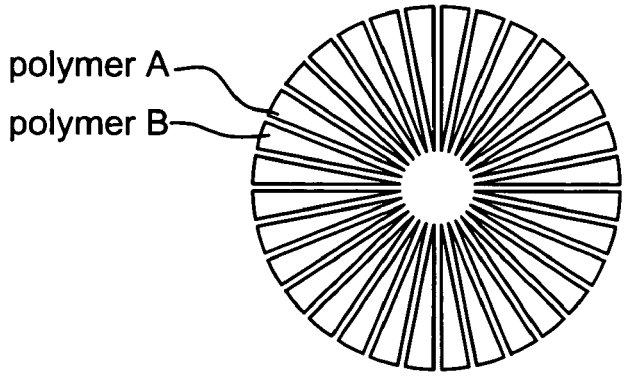
FIG. 4 is a cross-sectional view of ultrafine fibers after splitting the conjugate fiber shown in FIG. 1.
Figure 5:
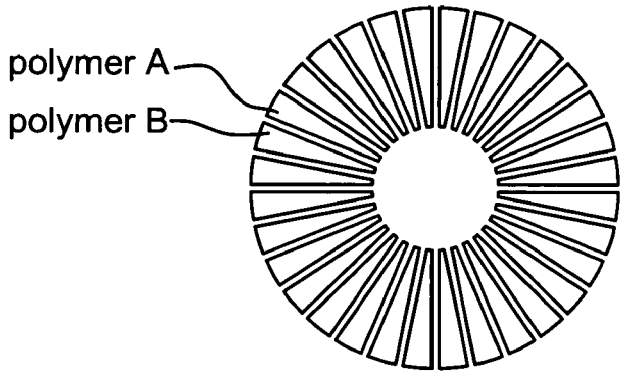
FIG. 5 is a cross-sectional view of ultrafine fibers after splitting the conjugate fiber shown in FIG. 2.
Figure 6:
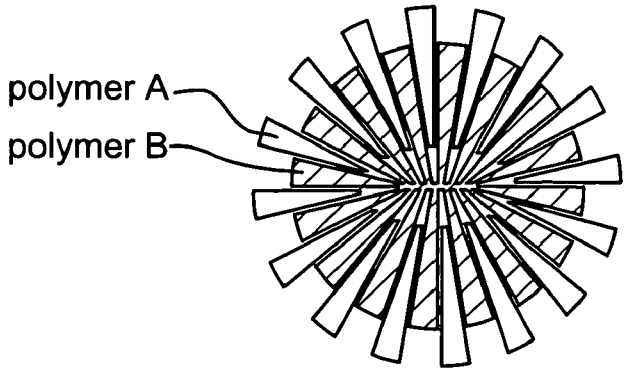
FIG. 6 is a cross-sectional view of ultrafine fibers after splitting the conjugate fiber shown in FIG. 3.

Because of the physical properties of polymers at low crystallization degrees, the non-woven fabric contracts so that the superficial area of the non-woven fabric shrinks to a degree of 5% to 35%. Thus, a substrate of ultrafine fibers is provided. For the two reasons, even containing 24 to 128 parts made of the first and second polymers, the conjugate fiber can easily be split as shown in FIGS. 4 through 6.

The method of the present invention would better be used to split a conjugate fiber including 24 to 128 parts arranged like the segments of an orange. In a case that the number of the parts is less than 24, after a conjugate fiber is split, the resultant ultrafine fibers will not be flat. In another case that the number of the parts is larger than 128, a conjugate fiber cannot easily be split.

Figure 7:
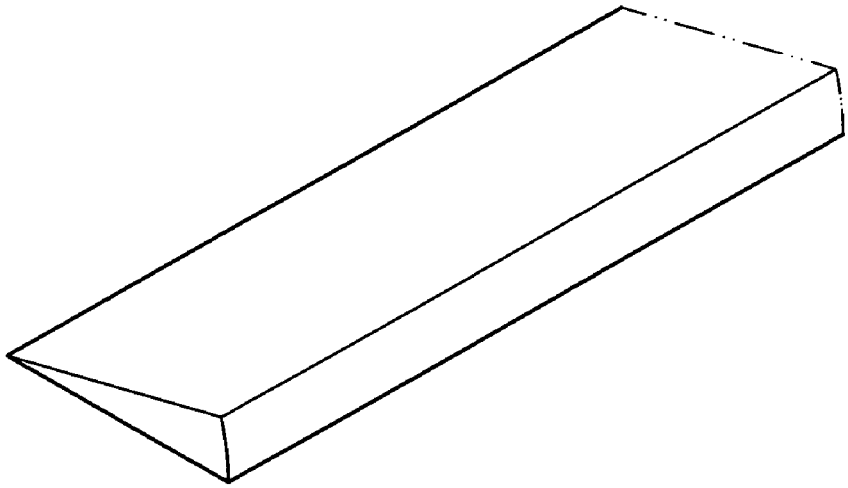
FIG. 7 is perspective view of an ultrafine fiber obtained from the conjugate fiber made in the method according to the present invention.
Figure 8:
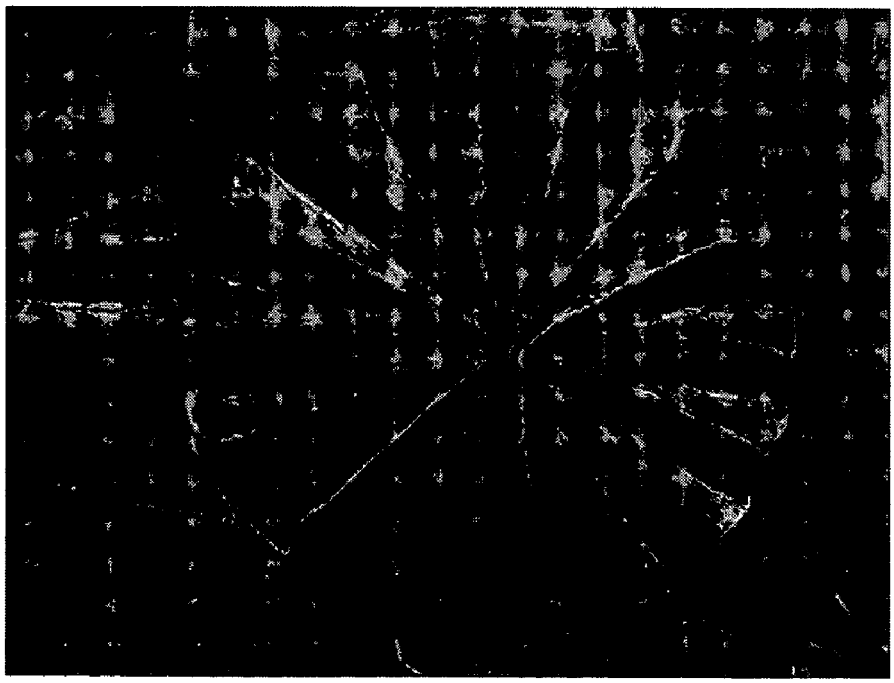
FIG. 8 is a cross-sectional view of the conjugate fiber taken by an electron microscope.
Figure 9:
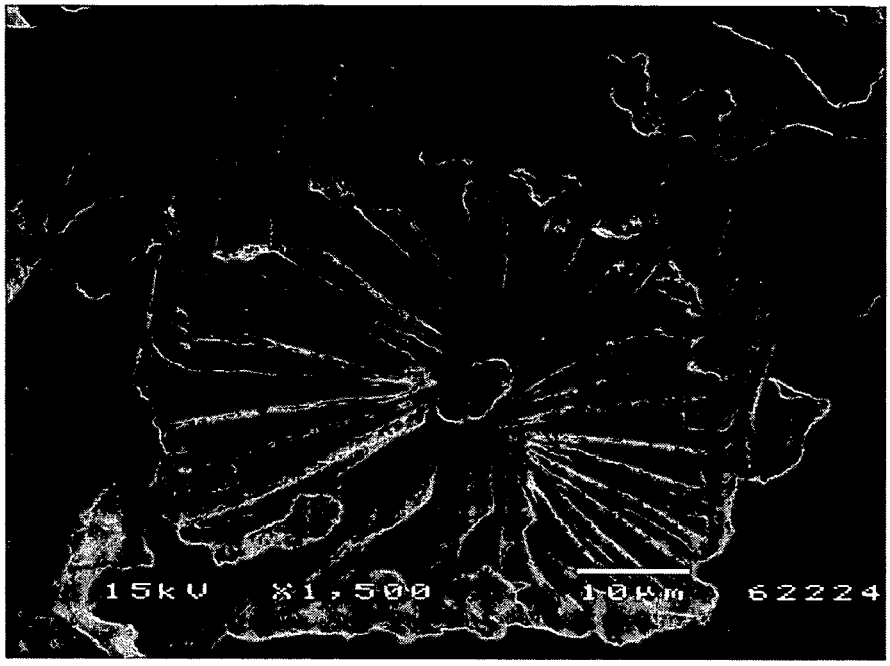
FIG. 9 is a perspective view of the conjugate fiber shown in FIG. 8.
Figure 10:
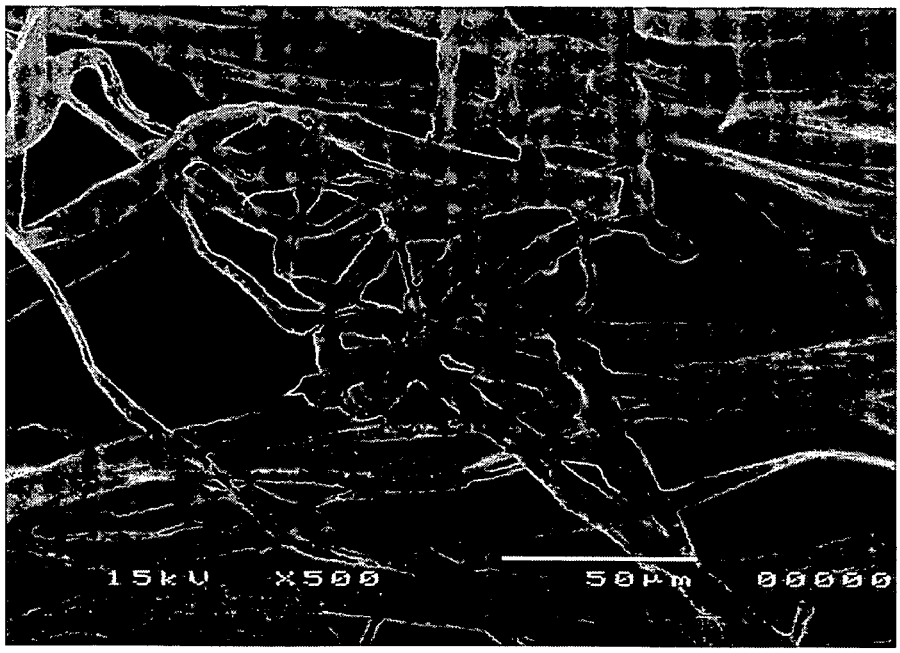
FIG. 10 is a cross-sectional view of artificial leather made from the conjugate fiber shown in FIG. 8.

Referring to FIG. 7, the ultrafine fibers become flat because of the contraction in hot water of 60 to 100 degrees Celsius before or after the heating by the microwave. Thus, the substrate provides a dense feel. After the splitting, the length (a) of the ultrafine fibers is 5 to 70 mm, and the radial dimension (b) of the ultrafine fibers is 2 to 25 μm (about 0.03 to 5 den), and the transverse dimension (c) of the ultrafine fibers is 0.5 to 8 μm (about 0.004 to 0.5 den). The length (a) would better be 38 to 64 mm, and the radial dimension would better be 8 to 20 μm (about 0.5 to 3 den), and the transverse dimension would better be 1 to 5 μm (about 0.008 to 0.2 den).

The first polymer may be a polyester such as polyethylene terephthalate ("PET"), polypropylene terephthalate ("PPT") and polybutylene terephthalate ("PBT").

The second polymer may be a polyamide or a polyamide copolymer. The polyamide may be adipic acid, azelate, terephthalate, isophthalate, cyclohexane 1,4-diacarboxylic acid, 1,6 hexamethylene diamide, trimethyl-1,6 hexamethylene diamide, 4,4'-diamino-dicyclohexylmethane ("PACM"), 4,4' diamino-dicyclohexylpropane, isophorone diamine, caprolactam, laulolactam, 4,4'-diphyl methane diisocyanate or toluene diisocyanate. The polyamide copolymer may be polyamide 6, polyamide 66, polyamide 11, polyamide 610 or 4,4'-diamino-dicyclohexylmethane 6 ("PCAM 6").

The first polymer can be added with 5% to 50% of a modified polyester copolymer such as polyethylene terephthalate containing 1% to 10% mole of SIPE so as to increase the polar group power so as to adjust the interface with the second polymer and the cross-sectional profile.

The non-woven fabric is heated by microwave and then submerged in a water soluble resin, dry or solvent polyurethane resin. After subsequent curing, washing and drying, a substrate for a semi-product of the artificial leather of ultrafine fibers is obtained.

The substrate can be submerged in water soluble polyurethane resin to obtain the final product of the artificial leather of ultrafine fibers.

Alternatively, the non-woven fabric is submerged in water soluble resin (such as dissolvable polyurethane resin) and then heated by microwave so that the polyurethane resin is cured and dried while the fibers are split into the ultrafine fibers, thereby obtaining a substrate for a semi-product of the artificial leather of ultrafine fibers is obtained.

The surface of the artificial leather can be ground to obtain even thickness and the superficial tiny fibers are more dispersed and delicate. The artificial leather can be then scrubbed by a crumpling machine to further split the internal fibers such that the superficial grain becomes finer.

In the production of the artificial leather of ultrafine fibers, neither alkali solution nor solvent is used to reduce and split the fibers. Hence, there is no pollution of the environment. The conjugate fibers used in the substrate include flat ultrafine fibers so that the substrate can be used in artificial leather, wipers, polishers for electronic devices and fabrics.

The method for making the artificial leather of the present invention will be described through the description of three embodiments. The embodiments of the artificial leather of the present invention will be compared with artificial leather made of conventional sea-island fibers each including 37 island-type portions.

According to the first embodiment of the present invention, PET (IV=0.64) made by Far Eastern Textile Ltd. and NY6 (RV=2.4) made by BASF are conjugate spun at a ratio of 55:45. The spinneret includes 32 sectors. The spinning is conducted at a temperature of 295 degrees Celsius. The reeling is conducted at a rate of 850 m/min. There are made un-drawn yarns with a fineness of 8 den, an elongation of 450% and tensile strength of 1.7 g/den. The un-drawn yarns are drawn by a rate of 200%. Drawn rollers are operated at a temperature of 50 degrees Celsius. The yarns are dried at a temperature of 60 degrees Celsius. Finally, the yarns are cut into fibers with a fineness of 4.5 den, an elongation of 80%, tensile strength of 3.3 g/den and a length of 51 mm referring to FIG. 4.

The fibers are opening, carding, cross-lapping and needle punch so that a non-woven fabric is made with a width of 153 cm, a unit weight of 250 g/m$^2$ and a thickness of 1.8 mm. The non-woven fabric is submerged in water for 3 minutes and then squeezed by a pressing roller so that the ratio of the weight of the water to that of the non-woven fabric is 0.5:1. The non-woven fabric is heated for 1 minute by microwave at an evaporation rate of vaporizing 1 gram of water per minute with 100 W so as to split the conjugate fibers. Each of the conjugate fibers is split into 32 identical portions with a radial dimension of 12 μm and a transverse dimension of 2.3 μm referring to FIG. 5. The non-woven fabric is rolled by a pressing roller operated at a temperature of 150 degrees Celsius so that the density thereof becomes 0.25 g/cm$^3$. The non-woven fabric can be submerged in water solvable resin so as to form a substrate of the artificial later. The substrate is dried and ground by a grinding machine (240-mesh sandpaper) and scrubbed at a rate of 10 times per minute. The substrate is coated with a polyurethane resin so as to form the artificial leather with a thickness of 1.5 mm referring to FIG. 6.

According to the second embodiment of the present invention, PBT (IV=0.94) made by Chang Chun Petrochemical Co., Ltd. and NY6 (RV=2.7) made by BASF are conjugate spun at a ratio of 50:50. The spinneret includes 32 sectors. The spinning is conducted at a temperature of 280 degrees Celsius. The reeling is conducted at a rate of 1350 m/min. There are made un-drawn yarns with a fineness of 10 den, an elongation of 550% and tensile strength of 1.5 g/den. The un-drawn yarns are drawn by a rate of 300%. Drawn rollers are operated at a temperature of 70 degrees Celsius. The yarns are dried at a temperature of 70 degrees Celsius. Finally, the yarns are cut into fibers with a fineness of 4.5 den, an elongation of 80%, tensile strength of 3.5 g/den and a length of 51 mm.

The fibers are opening, carding, cross-lapping and needle punch so that a non-woven fabric is made with a width of 153 cm, a unit weight of 280 g/m$^2$ and a thickness of 2.2 mm. The non-woven fabric is submerged in water for 2 minutes and then squeezed by a pressing roller so that the ratio of the weight of the water to that of the non-woven fabric is 0.8:1. The non-woven fabric is heated for 1.5 minutes by microwave at an evaporation rate of vaporizing 1 gram of water per minute with 50 W so as to split the conjugate fibers. Each of the conjugate fibers is split into 32 identical portions with a radial dimension of 12 μm and a transverse dimension of 2.3 μm referring to FIG. 5. The non-woven fabric is rolled by a pressing roller operated at a temperature of 140 degrees Celsius so that the density thereof becomes 0.27 g/cm$^3$. The non-woven fabric can be submerged in solvent polyurethane resin, washed and dried so as to form a substrate of the artificial later. The substrate is dried and ground by a grinding machine (sandpaper specifications: 150-mesh and 240-mesh) and scrubbed at a rate of 10 times per minute. The substrate is coated with a polyurethane resin so as to form the artificial leather with a thickness of 1.5 mm.

According to the third embodiment of the present invention, PBT (IV=0.94) made by Chang Chun Petrochemical Co., Ltd. and CO-PET (including SIPE at a molecular percentage of 2.5%) made by Shinkong Synthetic Fibers Corp. are mixed at a ratio of 70:30. The mixture and NY6 (RV=2.4) made by BASF are conjugate spun at a ratio of 50:50. The spinneret includes 32 sectors. The spinning is conducted at a temperature of 282 degrees Celsius. The reeling is conducted at a rate of 1350 m/min. There are made un-drawn yarns with a fineness of 12 den, an elongation of 300% and tensile strength of 1.5 g/den. The un-drawn yarns are drawn by a rate of 300%. Drawn rollers are operated at a temperature of 70 degrees Celsius. The yarns are dried at a temperature of 70 degrees Celsius. Finally, the yarns are cut into fibers with a fineness of 4.5 den, an elongation of 80%, tensile strength of 3.5 g/den and a length of 51 mm.

The fibers are opening, carding, cross-lapping and needle punch so that a non-woven fabric is made with a width of 153 cm, a unit weight of 230 g/m$^2$ and a thickness of 2.0 mm. The non-woven fabric is submerged in water for 3 minutes and then squeezed by a pressing roller so that the ratio of the weight of the water to that of the non-woven fabric is 0.5:1. The non-woven fabric is heated for 1 minute by microwave at an evaporation rate of vaporizing 1 gram of water per minute with 25 W so as to split the conjugate fibers. Each of the conjugate fibers is split into 32 identical portions with a radial dimension of 12 μm and a transverse dimension of 2.3 μm. The non-woven fabric can be submerged in a solvent polyurethane resin, washed and dried so as to form a substrate of the artificial later. The substrate is ground by a grinding machine (sandpaper specifications: 150-mesh and 240-mesh) and scrubbed at a rate of 20 times per minute. The substrate is coated with a dissolvable polyurethane resin so as to form the artificial leather with a thickness of 1.3 mm.

According to the present invention, there were made conjugate fibers each including 32 sectors of polyester and polyamide. According to prior art, there were made sea-island conjugate fibers each including 37 island portions. The island portions are made of polyamide while the sea portion is made of polyester. Comparison was made between artificial leather based on the conjugate fibers of the present invention and artificial leather based on the conventional sea-island conjugate fibers.

TABLE 1

| | Shape of Fibers | Fineness of Fibers | Thickness of Artificial Leather | Weight |
|---|---|---|---|---|
| Unit | | den | mm | g/m$^2$ |
| Test Method | | ASTM D-1577 | ASTM D-1777 | ASTM D-3776 |
| Splittable Fibers with 32 Sectors | Flat | 0.04-5 | 1.5 | 545 |

TABLE 1-continued

| | Shape of Fibers | Fineness of Fibers | Thickness of Artificial Leather | Weight |
|---|---|---|---|---|
| Sea-Island Fibers with 37 Island Portions | Round | 0.07-0.1 | 1.5 | 550 |

TABLE 2

| | Strength against Tearing (Longitudinal) | Strength against Tearing (Transverse) | Strength against Tension (Longitudinal) | Strength against Tension (Transverse) |
|---|---|---|---|---|
| Unit | kg | kg | Kg/cm | kg/cm |
| Test Method | ASTM D-2262 | ASTM D-2262 | ASTM D-1682 | ASTM D-1682 |
| Splittable Fibers with 32 Sectors | 13.2 | 12.5 | 70 | 55 |
| Sea-Island Fibers with 37 Island Portions | 11.7 | 10.8 | 65 | 47 |

TABLE 3

| | Strength against Peeling (Longitudinal) | Strength against Peeling (Transverse) | Strength against Breaking | Flexibility |
|---|---|---|---|---|
| Unit | kg/3 cm | kg/3 cm | $kg/cm^2$ | degree |
| Test Method | DIN 53357 | DIN 53357 | ASTM-D3786 | TM 029 |
| Splittable Fibers with 32 Sectors | 18 | 13.5 | 43 | 5.5 |
| Sea-Island Fibers with 37 Island Portions | 14.8 | 10 | 30.5 | 3.8 |

According to Tables 1 through 3, the strength of the conjugate fibers with 32 sectors is larger than that of the sea-island conjugate fibers with 37 island portions. This is because the conjugate fibers did not lose any weight when they were split so that the structure of the non-woven fabric was not damaged and the strength of the non-woven fabric remained unchanged. On the other hand, the flexibility of the conjugate fibers with 32 sectors is higher than that of the sea-island conjugate fibers with 37 island portions because the shape of the sectors of the conjugate fibers are flat.

The flexibility is rated from 0 to 10. The higher the value is, the more flexible the fibers are.

Comparison is made between the method of the present invention and a conventional method.

TABLE 4

| | Dissolution Treatment | Loss of Weight | Process | Consumption of Energy | Pollution of Environment |
|---|---|---|---|---|---|
| Splittable Fibers with 32 Sectors | Not Needed | No | Simple | 50% less than Counterpart | No Water &Air Pollution |
| Sea-Island Fibers with 37 Island Portions | Needed | 20% to 40% | Complicated | High | Water &Air Pollution and Waste from Dissolution |

The present invention has been described through the illustration of the embodiments. Those skilled in the art can derive variations from the embodiments without departing from the scope of the present invention. Therefore, the embodiments shall not limit the scope of the present invention defined in the claims.

The invention claimed is:

1. A method for splitting a split type conjugate fiber, the method comprising:

providing a first polymer with crystallization of 40% to 95% and a second polymer with crystallization of 1% to 25%, the first polymer being polyester and the second polymer being polyamide, the weight ratio of the first polymer to the second polymer being 90:10 to 10:90;

making a split type conjugate fiber of the first and second polymers by conjugate spinning;

submerging the split type conjugate fiber in water so that the split type conjugate fiber contains water; and heating and splitting the split type conjugate fiber containing water into fine fibers by microwave at a rate of vaporizing 1 gram of water per minute with 10 watt to 500 watt.

2. The method according to claim 1 wherein making the split type conjugate fiber includes making the split type conjugate fiber having 24 to 128 segments of the first and second polymers alternately.

3. The method according to claim 1 wherein providing the first polymer includes providing the polyester selected from a group consisting of polyethylene terephthalate, polypropylene terephthalate and polybutylene terephthalate.

4. The method according to claim 1, wherein providing the second polymer includes providing the polyamide selected from a group consisting of adipic acid, azelate, terephthalate, isophthalate, cyclohexane 1,4-diacarboxylic acid, 1,6 hexamethylene diamide, trimethyl-1,6 hexamethylene diamide, 4,4'-diamino-dicyclohexylmethane, 4,4'-damino-dicyclohexylprophane, isophorone diamine, caprolactam, laulolactam, 4,4'-diphyl methane diisocyanate and toluene diisocyanate.

5. The method according to claim 1 wherein providing the second polymer includes providing the polyamide selected from a group consisting of polyamide 6, polyamide 66, polyamide 11, polyamide 610 and 4,4'-diamino-dicyclohexylmethane 6.

6. The method according to claim 1 wherein heating and splitting the split type conjugate fiber into the fine fibers includes heating and splitting the split type conjugate fiber into the fine fibers including a flat form with a length of 5 mm to 70 mm, a cross-sectional radial size of 2 μm to 25 μm and a cross-sectional transverse size of 0.5 μm to 8 μm.

7. The method according to claim 1 wherein providing the first polymer includes providing the first polymer added with 5% to 50% of polyethylene terephthalate containing 1% to 10% mole of SIPE.

8. A method for splitting a non-woven fabric of split type conjugate fibers, the method comprising:

providing a first polymer with crystallization of 40% to 95% and a second polymer with crystallization of 1% to 25%, the first polymer being polyester and the second polymer being polyamide, the weight ratio of the first polymer to the second polymer being 90:10 to 10:90;

making a plurality of split type conjugate fibers of the first and second polymers by conjugate spinning;

making a non-woven fabric from the plurality of split type conjugate fibers;

submerging the non-woven fabric in water so that the plurality of split type conjugate fibers contain water; and heating and splitting the non-woven fabric into fine fibers by microwave at a rate of vaporizing 1 gram of water per minute with 10 watt to 500 watt after submerging the non-woven fabric.

9. The method according to claim 8 comprising the step of using hot water at 60 to 100 degrees Celsius to cause the non-woven fabric to contract after submerging the non-woven fabric and before or after heating and splitting the non-woven fabric.

10. A method for making artificial leather from conjugate fibers, the method comprising:

providing a first polymer with crystallization of 40% to 95% and a second polymer with crystallization of 1% to 25%, the first polymer being polyester and the second polymer being polyamide, the weight ratio of the first polymer to the second polymer being 90:10 to 10:90;

making a plurality of split type conjugate fibers of the first and second polymers by conjugate spinning;

making a non-woven fabric from the conjugate fibers;

submerging the non-woven fabric in water so that the plurality of split type conjugate fibers contain water;

heating and splitting each of the plurality of split type conjugate fibers containing water into fine fibers by microwave at a rate of vaporizing 1 gram of water per minute with 10 watt to 500 watt and making the non-woven fabric into a substrate; and submerging the substrate in a resin or coating the substrate with a resin to make artificial leather.

11. The method according to claim 10 wherein making the plurality of split type conjugate fiber includes making the plurality of split type conjugate each having 24 to 128 segments of the first and second polymers alternately.

12. The method according to claim 10 wherein heating and splitting each of the plurality of split type conjugate fibers into the fine fibers includes heating and splitting each of the plurality of split type conjugate fibers into the fine fibers including a flat form with a length of 5 mm to 70 mm, a cross-sectional radial size of 2 μm to 25 μm and a cross-sectional transverse size of 0.5 μm to 8 μm.

13. The method according to claim 10 wherein providing the the first polymer includes providing the first polymer added with 5% to 50% of polyethylene terephthalate containing 1% to 10% mole of SIPE.

14. The method according to claim 10 further comprising using hot water at 60 to 100 degrees Celsius to cause the non-woven fabric to contract after submerging the non-woven fabric and before or after heating and splitting the non-woven fabric.

15. A method for making artificial leather from conjugate fibers, the method comprising:

providing a first polymer with crystallization of 40% to 95% and a second polymer with crystallization of 1% to 25%, the first polymer being polyester and the second polymer being polyamide, the weight ratio of the first polymer to the second polymer being 90:10 to 10:90;

making plurality of split type conjugate fibers of the first and second polymers by conjugate spinning;

making a non-woven fabric from the plurality of split type conjugate fibers;

submerging the non-woven fabric in water soluble resin so that the plurality of split type conjugate fibers contain water; and heating the non-woven fabric to cure the water soluble resin by microwave at a rate of vaporizing 1 gram of water per minute with 10 watt to 500 watt, thereby splitting the split type conjugate fibers to make artificial leather.

16. The method according to claim 15 wherein providing the first polymer includes providing the first polymer added with 5% to 50% of polyethylene terephthalate containing 1% to 10% mole of SIPE.

* * * * *